US005776040A

United States Patent [19]

Webb et al.

[11] Patent Number: 5,776,040

[45] Date of Patent: Jul. 7, 1998

[54] AUXILIARY WEIGHT SYSTEM FOR EXERCISE APPARATUS

[75] Inventors: Gregory M. Webb; William F. Halsey, both of Independence; Michael W. Morris, Galax, all of Va.

[73] Assignee: Nautilus International, Inc., Independence, Va.

[21] Appl. No.: 691,693

[22] Filed: Aug. 2, 1996

[51] Int. Cl.[6] ..... A63B 21/06

[52] U.S. Cl. ..... 482/98; 482/99

[58] Field of Search ..... 482/94, 97–103, 482/133, 135–138, 208

[56] References Cited

U.S. PATENT DOCUMENTS

| | | | |
|---|---|---|---|
| 4,627,615 | 12/1986 | Nurkowski | 482/99 X |
| 4,697,809 | 10/1987 | Rockwell | 482/102 |
| 4,834,365 | 5/1989 | Jones | 482/100 X |
| 5,080,351 | 1/1992 | Rockwell | 482/100 X |
| 5,580,341 | 12/1996 | Simonson | 482/100 |

*Primary Examiner*—Richard J. Apley
*Assistant Examiner*—John Mulcahy
*Attorney, Agent, or Firm*—Bell Seltzer Intellectual Property Law Group of Alston & Bird, LLP

[57] ABSTRACT

An exercise apparatus has an auxiliary weight system which can be used with virtually any exercise machine irrespective of its stroke length and which is relatively free of resistance due to friction caused by the interaction of the weights and their guide rods. The exercise apparatus of the present invention includes: a frame; an exercise arm attached to and movable relative to the frame; a set of first weights, each of which is of a first magnitude; a first moving unit for moving at least one of the set of first weights along a first path; a set of second weights, each of which is of a second magnitude that differs from the first magnitude; a second moving unit for moving at least one of the set of second weights along a second path that is noncoincident with the first path; and an interconnecting assembly for interconnecting the first and second moving units with the exercise arm such that movement of the exercise arm draws at least one of the first set of weights and at least one of the second set of weights along, respectively, the first and second paths.

17 Claims, 5 Drawing Sheets

AUXILIARY WEIGHT SYSTEM FOR EXERCISE APPARATUS

FIELD OF THE INVENTION

The present invention relates generally to exercise equipment, and relates more particularly to resistance systems for exercise equipment.

BACKGROUND OF THE INVENTION

Exercise devices, and in particular weight training machines, typically include a mechanical member that the user moves along a prescribed path for exercise. Conventionally, movement of the mechanical member is resisted in some fashion to render the movement more difficult and thereby intensify the exercise. The most common means for providing resistance to movement of the mechanical member is a unit that connects the mechanical member with one or more weights such that the weights are raised in response to the movement of the mechanical member.

Often the weights of an exercise machine are provided in a stack; any or all of the weights (which are typically identical in weight) can be secured to a connecting rod that extends through the entire weight stack via apertures in the weights. The connecting member is then interconnected with the mechanical member, either directly or indirectly, via a one or more of belts, chains, cables, levers, or other means. Movement of the mechanical member by a user is resisted by the weight secured to the connecting rod.

In one commonly employed configuration, the weights are secured to the connecting rod via a selecting pin, which can be inserted through an aperture included in each weight or a gap between weights and into an opening in the connecting rod. Insertion of the connecting pin into a connecting rod aperture causes the portion of the weights in the stack above the pin (i.e., those weights positioned between the pin and the interconnecting belt) to travel as a substack with the connecting rod and thereby provide resistance to movement of the exercise arm; the portion of the weights in the stack below the pin (i.e., those weights positioned farther from the interconnecting belt than the pin) remain stationary and provide no resistance to movement of the exercise arm. Of course, the amount of weight providing resistance to the movement is equal to the weight of the substack of weights travelling with the connecting rod. The amount of resistive weight can be easily adjusted by repositioning the selecting pin in the connecting rod in a different weight or between different weights so that a different number of weights travel with the connecting rod.

Space limitations often restrict the number of weights that are included in a weight stack. Because it is desirable to provide exercise machines that can be comfortably used by virtually any user (which may include both weak or infirm individuals using the machine for rehabilitation and very strong individuals for whom substantial resistance is required), the weights typically provided are rather heavy. Also, generally the individual weights in a stack are of the same magnitude. As the weights in a stack are generally both heavy and uniform in magnitude, the incremental increase in resistance experienced by a user adding but a single weight to the travelling substack can be quite significant. Such an increase can be particularly onerous for novices, rehabilitation patients, elderly users, and others who lack strength.

One attempt to address the problem of an overly high incremental weight increase is offered in U.S. Pat. No. 4,834,365 to Jones. The Jones machine includes two weight stacks: one stack comprising conventional heavier weights; and one stack comprising much lighter weights. These stacks are positioned so that the stack of lighter weights resides directly above the stack of heavier weights. Both stacks share a common connecting rod to which a portion of their weights can be secured. When the mechanical member of the exercise machine is moved, the desired number of weights of both stacks travel with the connecting rod and provide resistance. The lighter weights contribute to the resistance experienced by the user and therefore provide more resistance magnitude options. For example, a rehabilitating patient may be exercising on a machine that has a large weight stack of twenty pound weights and a lighter weight stack of one pound weights. If the patient's rehabilitation is best served by a resistance of thirty pounds, he can add resistance in one pound increments with the heavier weight stack to a twenty pound weight from the heavier stack to total thirty pounds rather than being forced to proceed directly from twenty to forty pounds of resistance.

Although it can reduce the incremental increase in weight resistance for an exercise machine, and thereby increase a user's options, the Jones system has a significant shortcoming. Because the lighter weight stack is positioned directly above the heavier weight stack, the range of travel (often termed the "stroke") of the connecting rod as it carries one or more of the heavier weights is limited to the distance between the uppermost of the heavier weights and the lowermost of the lighter weights (or any support upon which the lowermost lighter weight rests); any additional travel of the connecting rod would cause the uppermost heavier weight to collide with the lowermost lighter weight or its underlying support. For the specific low back exercise machine described in Jones, the stroke is about three inches. A stroke this small is simply not suitable for most exercise devices, particularly those that are designed to increase both the strength and flexibility of the user.

An attempt to address this shortcoming is embodied in an exercise machine that includes a short, horizontally-extending hanging pin attached to the uppermost weight of a heavier weight stack. A complimentary hanging pin is fixed to the frame such that the ends of the hanging pins are adjacent and the hanging pins themselves are generally coaxial. A set of lighter weights is stored on the frame hanging pin. If the user wishes to add one or more of the lighter weights to provide resistance, he can slide the desired number of weights along the frame hanging pin and onto the heavier weight stack hanging pin. These lighter weights travel with the heavier weights during exercise.

A considerable disadvantage to the Cybex system is that, when the lighter weights are placed on the heavier weight stack hanging pin, their weight causes the uppermost heavier weight (from which they are suspended) to tilt or cock slightly. This tilting action forces the uppermost weight against its guide rods and substantially increases the friction therebetween. The increased friction can elevate the resistance experienced by the user, and can do so in an inconsistent manner.

SUMMARY OF THE INVENTION

In view of the foregoing, it is an object of the present invention to provide an exercise apparatus with multiple weight stacks that can be employed with exercise machines having a stroke of virtually any practical length.

It is another object of the present invention to provide such an exercise apparatus that has minimal functional resistance added by the inclusion of multiple weight stacks.

It is also an object of the present invention to provide an auxiliary weight system that can be easily added to an existing exercise machine to increase the resistance options available to the user.

These and other objects are satisfied by the present invention, which provides an exercise apparatus having an auxiliary weight system which can be used with virtually any exercise machine irrespective of its stroke length and which is relatively free of resistance due to friction caused by the interaction of the weights and their guide rods. The exercise apparatus of the present invention includes: a frame; an exercise arm attached to and movable relative to the frame; a set of first weights, each of which is of a first magnitude; first moving means for moving at least one of the set of first weights along a first path; a set of second weights, each of which is of a second magnitude that differs from the first magnitude; second moving means for moving at least one of the set of second weights along a second path that is noncoincident with the first path; and interconnecting means for interconnecting the first and second moving means with the exercise arm such that movement of the exercise arm draws at least one of the first set of weights and at least one of the second set of weights along, respectively, the first and second paths. In this configuration, the second set of weights (usually the lighter set of weights) is positioned such that there is no interference with the first set of weights and thus the stroke of the exercise apparatus is not limited by the presence of the second weight set. Also, the inclusion of the second moving means reduces the amount of resistive friction that can build due to the presence of the second weight set.

In a preferred embodiment, the set of weights employed with the exercise apparatus comprises: a set of first weights of a first magnitude; a first connecting member (such as a first connecting rod); first means for connecting at least one of the first weights to the first connecting member; a set of second weights of a second magnitude that differs from the first magnitude; a second connecting member (such as a second connecting rod); second means for connecting at least one of the second weights to the second connecting member; and interconnecting means for interconnecting the first and second connecting members such that movement of said interconnecting means causes first weights connected to the first connecting member to travel along a first path and second weights connected to the second connecting member to travel along a second path that is noncoincident with the first path. It is preferred that the weights of the first set are ten pound weights and the weights of the second set are one pound weights. It is also preferred that the interconnecting means comprise a belt and pulley system. In one embodiment, separate belts are connected to each connecting member. In another embodiment, a belt is connected to the first connecting member, and the second connecting member is connected to the first set of weights through a mounting bracket. Either of these embodiments can easily be added to an existing exercise machine to augment its capabilities.

It is also preferred that the exercise apparatus of the present invention include a doubling unit. In a particularly preferred embodiment, the doubling unit includes: a carrier panel; a coupling member attached to said carrier panel and adapted for attachment to the exercise arm of an exercise machine; a first rotary member rotatably attached to the carrier panel; a second rotary member rotatably attached to the carrier panel; a first flexible member engaged with the first rotary member and adapted to be interconnected with the first set of weights and to be secured with the frame of the exercise machine; and a second flexible member engaged with the second rotary member and adapted to be interconnected with the second set of weights and to be secured with the frame. Movement of the exercise arm relative to the frame causes movement of the carrier panel over a first distance and the first and second weights over a second distance along first and second paths; the second distance is substantially two times as great as the first distance. In this configuration, the resistance experienced by a user is effectively doubled over that of a machine that lack such a doubling unit.

DETAILED DESCRIPTION OF THE INVENTION

The present invention will now be described more particularly hereinafter with reference to the accompanying drawings, in which present embodiments of the invention are shown. The invention can, however, be embodied in many different forms and should not be limited to the embodiments set forth herein; rather, these embodiments are provided so that this disclosure will be thorough and complete and will fully convey the scope of the invention to those skilled in this art.

Figure 1:
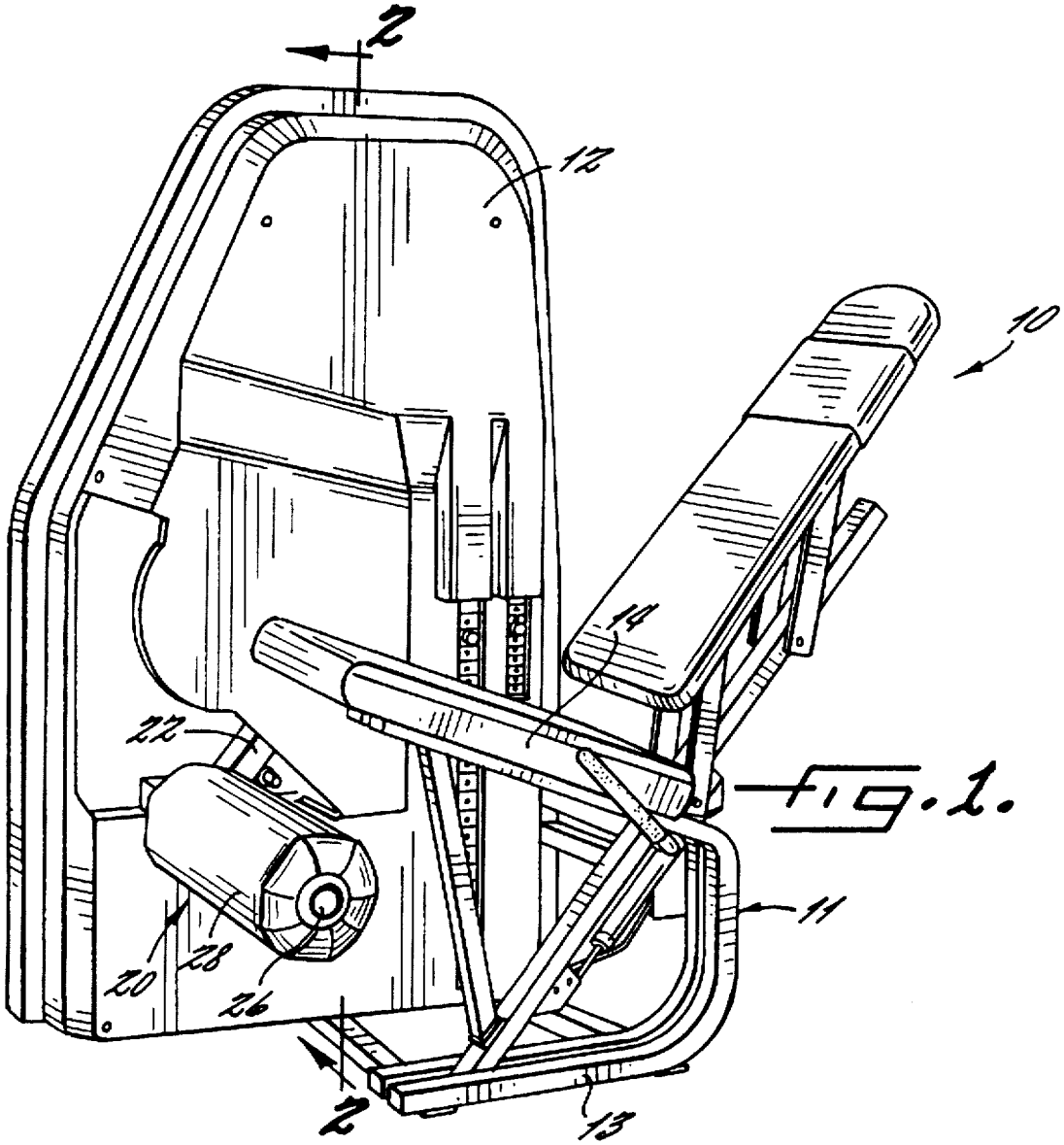
FIG. 1 is a perspective view of a leg extension machine of the present invention.
Figure 2:
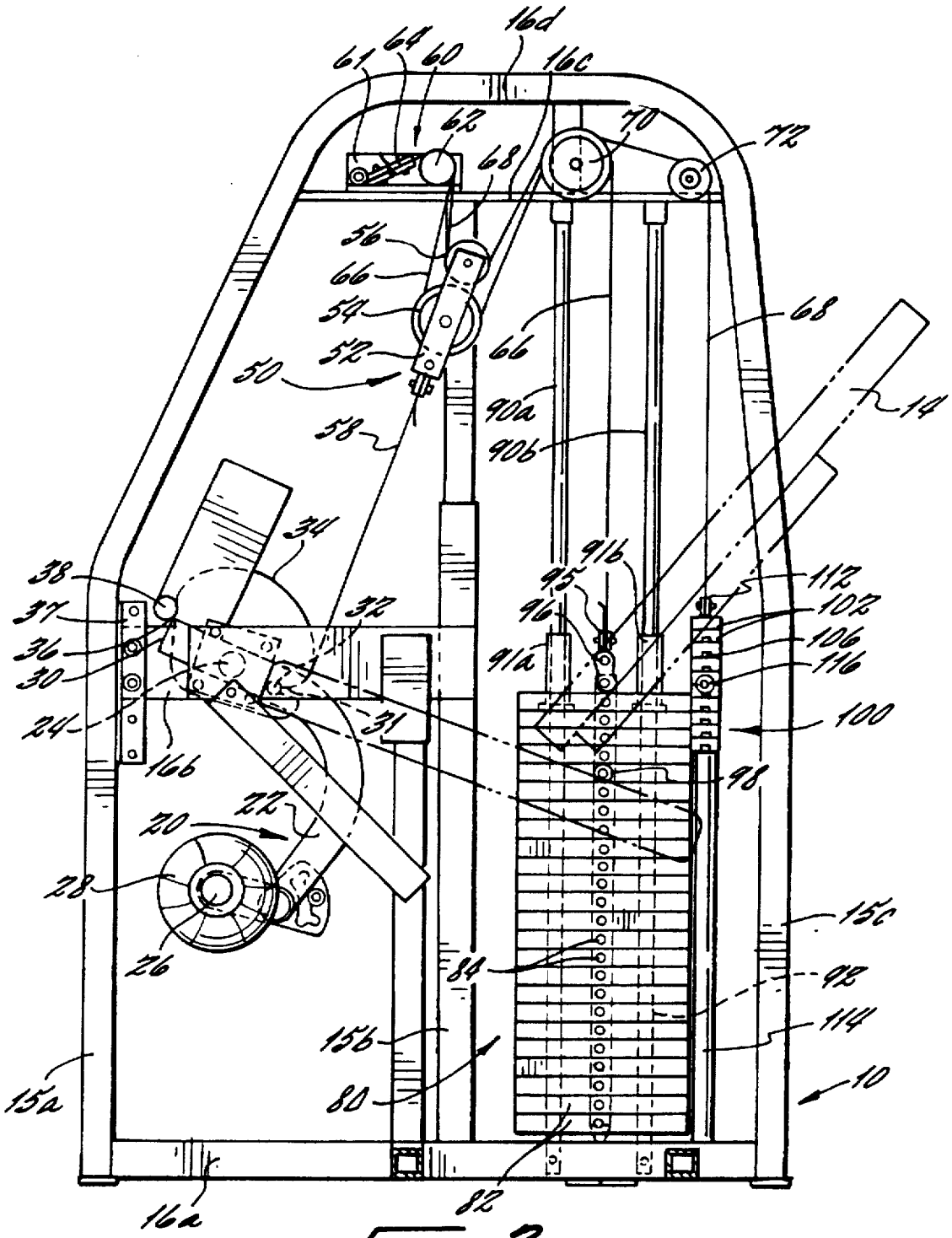
FIG. 2 is a section view taken along lines 2—2 of FIG. 1 showing the exercise arm in its retracted position and its heavier and lighter weights in their lowered positions.

Referring now to the Figures, a leg extension machine 10 is illustrated in FIGS. 1–4. As best seen in FIG. 1, the leg extension machine 10 includes a skeletal frame 11, a portion of which is covered by a plastic cover 12. The frame includes a base portion 13 upon which rests a seat assembly 14 configured to receive a seated occupant for exercising. As best seen in FIG. 2, the frame 11 also includes three generally upright members 15*a*, 15*b*, 15*c* which are connected at their lower ends by a horizontal cross-member 16*a*. The upright members 15*a* and 15*b* are connected at their medial portions by a horizontal cross-member 16*b*. The upright member 15*b* terminates at its upper end at a cross-member 16*c*, which extends horizontally between the upper end portions of upright members 15*a* and 15*c*. The upright members 15*a* and 15*c*, which are formed from a common tube, merge at their upper ends with a horizontal cross-member 16*d*.

Referring again to FIGS. 1 and 2, an exercise arm 20 is positioned below the front end (i.e., the end beneath a seated occupant's knees) of the seat assembly 14. The exercise arm 20 includes a crank portion 22, which is pivotally mounted to the cross-member 16*b* through a pivot pin 24. The crank portion 22 follows a generally downwardly-extending arcuate path from the pivot pin 24 to an extension shaft 26, which extends horizontally therefrom below and generally parallel with the front portion of the seat assembly 14. The extension shaft 26 is covered with a cylindrical cushion 28, which is positioned to engage the feet and ankles of an occupant during exercise.

Still referring to FIG. 2, a cam 30 is attached to the pivot pin 24 on the side of the cross-member 16*b* opposite the exercise arm crank portion 22. The cam 30 includes an arcuate camming surface 34 about its periphery; the camming surface 34 is of sufficient width to engage an overlying cam belt 58 during operation. A slot 31 is positioned at one end of the camming surface 34; the slot 31 receives one end of the cam belt 58 and fixes it to the cam 30 via an attachment pin 32. At the opposite end of the camming surface 34, a stop surface 36 is included and positioned to engage a stop pin 38 that is attached to the frame 11 via a bracket 37.

A doubling pulley unit 50 is attached to the cam belt 58 at the end opposite the cam 30 (FIG. 2). The doubling pulley unit 50 includes the cam belt 58, a carrier panel 52, a large pulley 54 rotatably mounted on the carrier panel 52, and a small pulley 56 also rotatably mounted to the carrier panel 52. The carrier panel 52 is suspended by a belt 66, which engages the large pulley 54, and a belt 68, which engages the small pulley 56. The lower end of the carrier panel 52 is attached to the upper end of the cam belt 58.

Each of the belts 66, 68 is secured at one end to a fixed end assembly 60 (FIG. 2). The fixed end assembly 60 includes a mounting bracket 61, which is mounted to the frame cross-member 16*c*, and a pivoting clamp 64, which is pivotally mounted to the mounting bracket 61. The clamp 64 secures the belts 66, 68 and thereby provides a substantially fixed point therefor. The fixed end assembly 60 also includes a transfer pulley 62, which is rotatably mounted to the end of the mounting block 61 opposite the clamp 64. Each of the belts 66, 68 travels from the clamp 64 over the transfer pulley 62 and downwardly to engage its respective pulley 54, 56 on the carrier panel 52.

From their respective engagements with the pulleys 54, 56, each belt 66, 68 then travels upwardly and rearwardly to engage a large diverting pulley 70 mounted on the rear portion of the cross-member 16*c* of the frame 11 (FIG. 2). The belt 66 then travels downwardly to interconnect with a heavier weight system 80. The small weight belt 68 travels generally horizontally and rearwardly to engage a small diverting pulley 72, which is also rotatably mounted to the cross-member 16*c*, then travels downwardly to interconnect with an auxiliary lighter weight system 100.

Figures 3, 4:
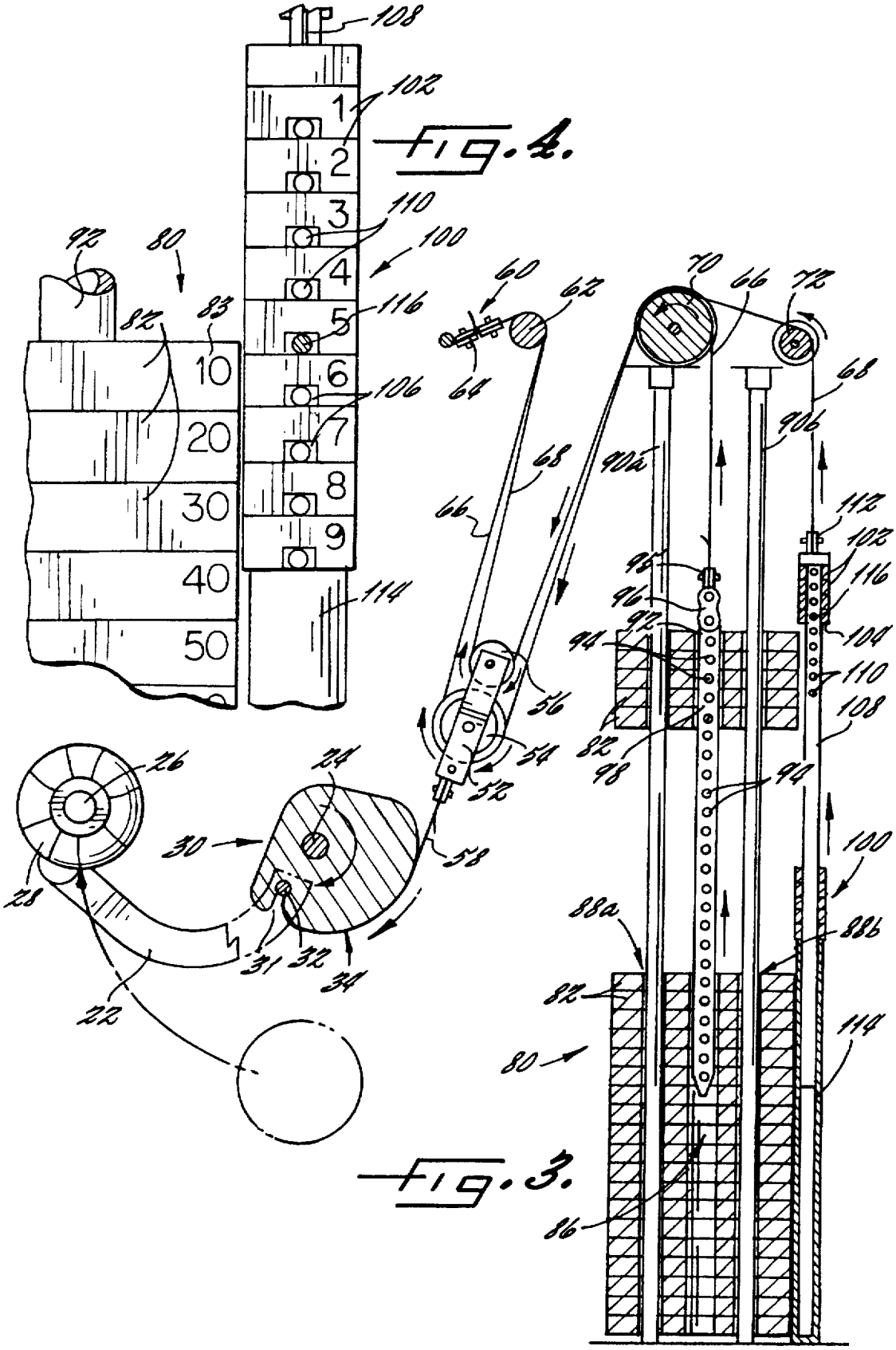
FIG. 3 is a partial view of the leg extension machine of FIG. 2 showing the exercise arm in its extended position and portions of the heavier and lighter weights in their raised positions.
FIG. 4 is a greatly enlarged view of the lighter weight stack and a portion of the heavier weight stack as shown in FIG. 2.

The heavier weight system 80 includes a plurality of vertically stacked weights 82, each of which in the present embodiment is 10 pounds, as indicated by a label 83 on each weight 82 (FIG. 4). Each of the weights 82 includes a horizontally-extending selection pin aperture 84 in one side wall, and a vertically-extending connecting rod aperture 86 which intersects with the selection pin aperture 84 at the center of the weight 82. Each weight 82 also includes a pair of guide rod apertures 88*a*, 88*b* (FIG. 3), which extend vertically through the weight 82 on opposite sides of the connecting rod aperture 86. The guide rod apertures 88*a*, 88*b* and the connecting rod apertures 86 are positioned on each weight 82 so that, as the weights 82 are vertically stacked, the guide rod aperture 88*a*, 88*b* and the connecting rod apertures 86 are aligned to form passages in the weight stack.

Referring again to FIG. 2, the weights 82 are maintained in their x-y positions (i.e., their positions along axes extending horizontally across FIG. 2 (the x-axis) and extending normal to the page in FIG. 2 (the y-axis)) and their angular orientations relative to the frame 11 about a vertical axis by a pair of cylindrical guide rods 90*a*, 90*b*. The cylindrical guide rods 90*a*, 90*b* extend vertically between and are fixed to the cross-member 16*a* and the cross-member 16*c*. Each guide rod 90*a*, 90*b* extends through a respective aligned set of guide rod apertures 88*a*, 88*b* in the weights 82 as they are vertically stacked. Two bushings 91*a*, 91*b* are slidably received on respective guide rods 90*a*, 90*b* and engage the uppermost of the weights 82.

A connecting rod 92 (FIG. 2) is connected to the end of the belt 66 that extends downwardly from the diverting pulley 70; this connection is achieved via a clamp 95 and a pivoting link 96 attached to the upper end of the connecting rod 92. The connecting rod 92 extends downwardly through the connecting rod apertures 86 in the weights 82. The connecting rod 92 includes apertures 94 which, when the connecting rod 92 is in a lowered position, align with corresponding selection pin apertures 84 of the weights 82. Thus, by inserting a selection pin 98 into the selection pin aperture 84 of a desired weight 82 and the corresponding aperture 94 of the connecting rod 92, a desired number of weights 82 can be interconnected with the exercise arm 20 to provide resistance to the movement thereof.

The lighter weight system 100 (FIG. 2) includes 9 generally rectangular one pound weights 102 (shown by the insignia 103 in FIG. 4) vertically stacked adjacent to and rearwardly of the heavier weights 82. Although one-pound weights are preferred, weights of any magnitude that differs from that of the weights 82 can be used. Each weight 102 includes a square, vertically-extending connecting rod aperture 104 in its center, and further includes an intersecting selection pin channel 106 that extends from the rear end face of each weight 102 along the underside of the weight 102 to intersect with the connecting rod aperture 104. The connecting rod apertures 104 are located in the weights 102 so that, when the weights are vertically stacked and aligned, the apertures 104 form a passage for receiving a connecting rod 108.

The connecting rod 108, which is of square cross-section, is attached to the end of the belt 68 that is positioned below the small diverting pulley 72 via a clamp 112. The connecting rod 108 extends downwardly through the connecting rod apertures 104 of the weights 102. The connecting rod 108 is received within and is slidable relative to a square receiving sleeve 114, which is fixed to the frame cross-member 16*a* and extends upwardly therefrom to terminate below and support the lowermost weight 102. The connecting rod 108 includes apertures 110 which are positioned to align with the selection pin channels 106 of the weights 102. Thus, by inserting a selection pin 116 into a selection pin channel 106 of a desired weight 102, and then further into an aperture 110 of a connecting rod 108, the exerciser can interconnect a portion of the weights 102 with the exercise arm 20 and provide resistance to the movement thereof.

In operation, an exerciser begins to exercise by inserting the selection pin 98 into the selection pin aperture 84 of the heavier weight 82 that represents the amount of resistance the exerciser wishes to receive from the heavier weight system 80. The exerciser then inserts the selection pin 116 into a selection pin channel 106 of the lighter weight 102 that represents the desired resistance the exerciser wishes to receive from the lighter weight system 100.

Once the selection pins 98, 116 are in place, the exerciser takes a seated position on the seat assembly 14 with his knees bent. His feet and ankles engage the exercise arm cushion 28. The exerciser then attempts to straighten his legs. Movement of the cushion 28 causes the crank portion 22 of the exercise arm 20 to pivot about the pivot pin 24 (in a clockwise direction as seen in FIGS. 2 and 3). This movement of the crank portion 22 also rotates the cam 30 from its stopped position, in which the stop surface 26 rests against the stop pin 38, in a clockwise direction as seen in FIGS. 2 and 3. As the cam 30 rotates, the cam belt 58 is drawn downwardly to overlie and wrap around the camming surface 34. This action draws the carrier panel 52 and its mounted pulleys 54, 56 downwardly also. Because ends of the large and small weight belt 66, 68 are fixed to the fixed end assembly 60, downward movement of the carrier panel 52 and, correspondingly, the large and small pulleys 54, 56, causes the opposite ends of the belts 66, 68 (the central portions of which engage the pulleys 54, 56) to rise. This in turn lifts their respective connecting rods 92, 108 and all weights 82, 102 secured thereto by the selection pins 98, 116 (see FIG. 3). The uppermost weight 82 and the uppermost weight 102 move upwardly substantially the same distance along their respective paths.

The exercise arm 20 can be returned to its original position by the occupant allowing his legs to flex. This action enables the weights 82, 102 to return to their original lowered positions. Notably, the x-y positions and angular orientations of the weights 82 are maintained by their interaction with the guide rods 90*a*, 90*b*. The x-y positions and orientations of the weights 102 are maintained by the interaction of the square connecting rod 108 with the square apertures 104 in the weights 102 and the square receiving sleeve 114.

It can be seen from FIG. 3 that, because the lighter weights 102 are positioned beside, rather than above, the heavier weights 82, and therefore travel along a path that is noncoincident with the path followed by the heavier weights 82, the lighter weights 102 that do not travel upwardly with the connecting rod 108 do not interfere with the movement of the heavier weights 82. Instead, weights from each set are free to move upwardly without interference from non-travelling weights of the other set. As a result, the "stroke" of the leg extension machine 10 (i.e., the angle through which the exercise arm 20 can be pivoted during exercise) is not limited by the relative positions of the heavier weights 82 and the lighter weights 102. Preferably, the exercise machine is configured such that the weights move at least 15 inches; more preferably, the stroke is at least 18 inches. Also, because the weights 82 and 102 are not directly connected, the inclusion of the weights 102 does not cause the weights 82 to tilt or cock and thereby increase frictional resistance.

Because the stroke of the leg machine is unimpeded by the positions of the heavier and lighter weights, the system of weights of the present invention is suitable for use with virtually any exercise machine that relies on the lifting of weights to provide resistance irrespective of the stroke of the machine. Examples of other suitable exercise machines include: machines for leg exercise, such as prone leg curl, leg press, seated leg curl, and seated calf machines; machines for hip exercise, such as hip abduction, adduction, and abduction/adduction machines, machines for neck exercise, such as 4-way neck, behind neck, and neck and shoulders machines; machines for the upper torso, such as 10-degree and 50-degree chest, chest and double chest, decline and incline press, bench press, reverse and super pullover, torso arm, seated dip, rowing back, and compound row machines; machines for the mid-torso, such as abdominal, lower abdominal, rotary torso, and low back machines; machines for the arms, such as multi-biceps, multi-triceps, and super forearm machines; and machines for the shoulders, such as lateral raise, overhead press, and rotary shoulder machines.

Another advantage offered by the system of weights of the present invention is its suitability for use with a "doubling" system, such as the doubling pulley unit 50. The doubling pulley unit 50 has the effect of essentially doubling the resistance provided by attached weights. The advantage of employing the doubling pulley unit 50 or other means for doubling the resistance provided by a weight system is that lighter, smaller, less expensive weights can be employed. The size and weight of the weights can be particularly important in the shipping and on-site transport and adjustment of the exercise machine. However, in a doubling system such as that exemplified herein by the doubling pulley system 50, the weights 82, 102 travel approximately twice the distance along their respective paths that the carrier panel 52 travels downwardly along its path toward the cam 30. Accordingly, the weights 82, 102 require space to move along their respective paths that is approximately twice the distance that would be required without the doubling pulley unit 50. Because the lighter weights 102 travel along a path that is noncoincident with the path travelled by the heavier weights 82, the necessary travel space for the weights can be made available.

Those skilled in this art will recognize that the present invention can exist in numerous alternative embodiments. For example, although the belt and pulley systems described and illustrated herein are preferred, chain and sprocket systems, cable-based systems, and other weight transfer systems can be substituted therefor. In addition, the belt and pulley systems and other weight transfer systems can take different configurations. As an example, the small diverting pulley 72, the large diverting pulley 70, and the transfer pulley 62 can be replaced by nonrotating direction-diverting members, such as projections which include arcuate surfaces over which the belts 66, 68 can slide. Also, the small diverting pulley 72 can be omitted entirely, with the belt 68 simply overlying the belt 66 as they both engage and travel over the large diverting pulley 70. Similarly, the transfer pulley 62 can be omitted such that the belts 66, 68 lead directly from the fixed end assembly 60 to the doubling pulley unit 50.

Those skilled in this art will also recognize that other means for interconnecting the exercise arm 20 with the weight systems 80, 100 can also be employed. Exemplary alternatives include mechanical linkages, slider-crank mechanisms, and combinations of these systems and belt-pulley systems such as that illustrated herein.

Further, the doubling pulley unit 50 can take different configurations than that illustrated herein and still be suitable for use with the present invention. For example, the belts 66, 68 can be merged at any point between their connections with their respective connecting rods 92, 108 and their connections with the fixed end assembly 60. If this were done at a point located between the connecting rod 108 and the point at which the belt 68 engages the small pulley 56 of the doubling pulley unit 50, the small pulley 54 can be omitted, and the doubling effect achieved by the doubling pulley unit 50 can still be provided by engagement of the remaining belt 66 with the large pulley 54. Such an arrangement may be desirable when a stack of lighter weights of the present invention is added to an existing exercise machine to augment the existing weight system and increase its versatility.

Those skilled in this art will recognize that doubling units of other configurations, or other units that otherwise adjust the resistance provided by the weights, that illustrated and described herein can be employed with the present invention. Also, the skilled artisan will understand that the weight system of the present invention can also be employed on exercise devices that lack a doubling unit, wherein both of the belts 66, 68 (or only one belt if the pair of belts has been merged at a point between the connecting rods 92, 108 and the cam 30) attach directly to the cam 30.

Figure 5:
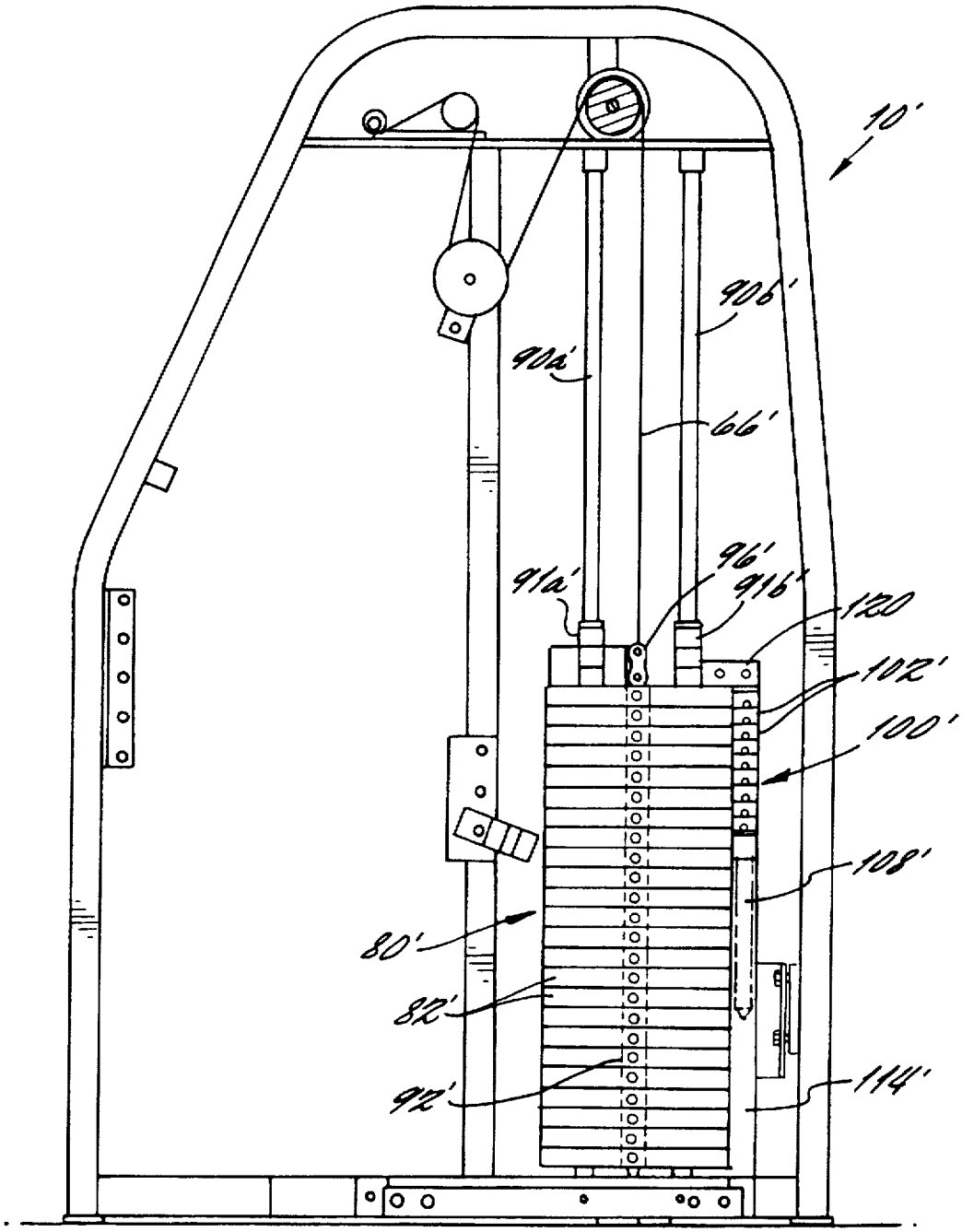
FIG. 5 is a side view of an alterative embodiment of an exercise machine of the present invention.
Figure 6:
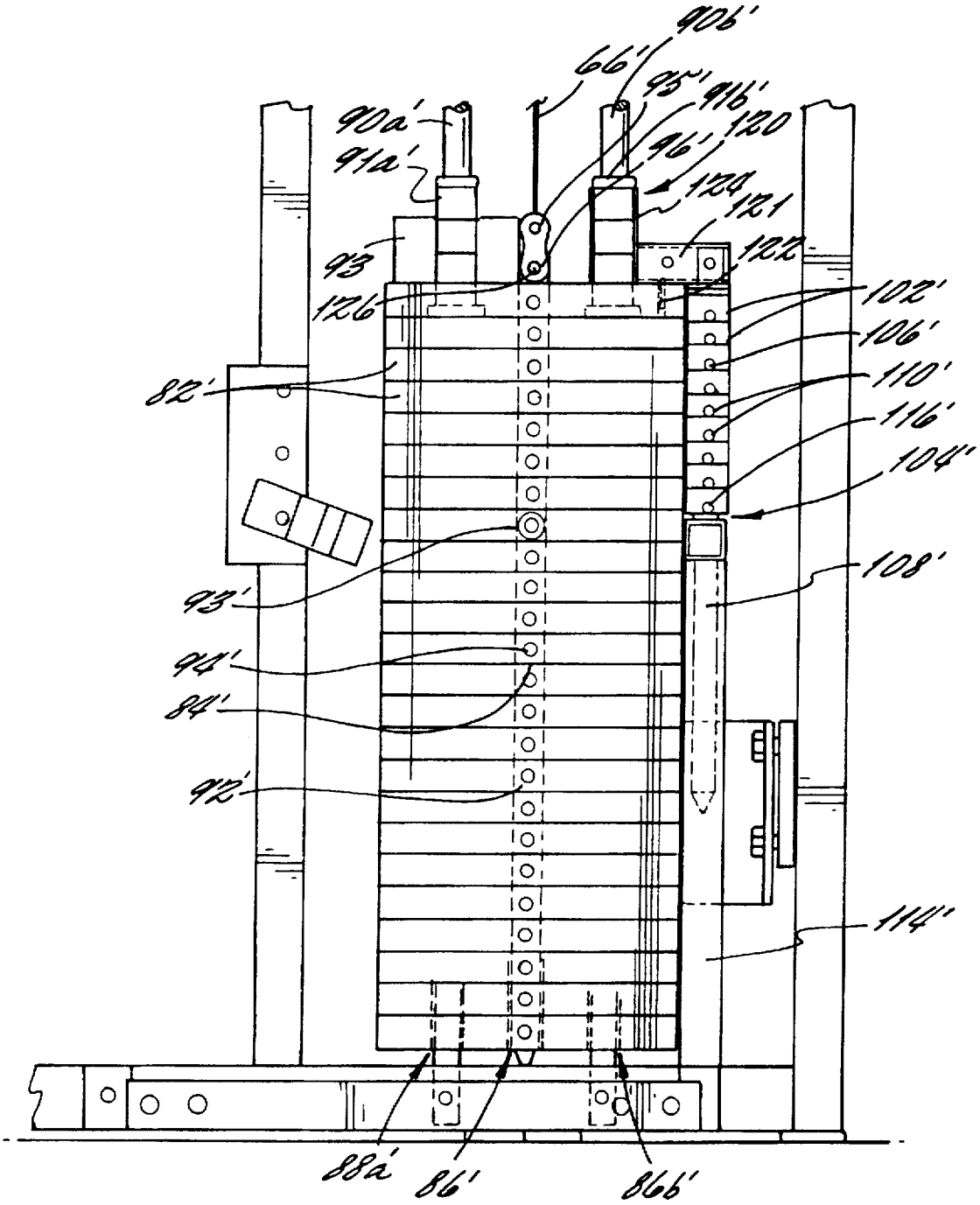
FIG. 6 is an enlarged partial side view of the exercise machine of FIG. 5.

Alternative embodiments can also include different means for maintaining the weights in their x-y positions and angular orientations as they travel along their respective paths. One alternative embodiment is illustrated in FIGS. 5 and 6, in which a heavier weight system 80' and a lighter weight system 100' are shown in an exercise machine 10'. The heavier weight system 80' includes a plurality of twenty pound weights 82' with selection pin apertures 84', connecting rod apertures 86', and guide rod apertures 88*a'*, 88*b'* as in the embodiment of FIGS. 1 through 4. Guide rods 90*a'*, 90*b'* are also included, as are bushings 91*a'*, 91*b'* and a connecting rod 92' with apertures 94'. The connecting rod is attached to the belt 66' through a clamp 95' and a pivoting link 96'. The weights 82' are secured to the connecting rod 92' via a selection pin 98'. The heavier weight system 80' further includes a seven pound counter weight 93 that fits over the bushing 91*a'*.

Still referring to FIGS. 5 and 6, the lighter weight system 100' includes nine one-pound weights 102' having connecting rod apertures 104' and selection pin channels 106'. The weights 102' travel on a square connecting rod 108', having apertures 110'. The connecting rod 108' is received within a square sleeve 114'. The weights 102' are secured to the connecting rod 108' with a selection pin 116'.

The lightweight system 100' lacks a belt attached to the connecting rod 108'; instead, the lighter weights 102' are connected to the uppermost heavier weight 82' through a mounting bracket 120 (FIG. 6). The mounting bracket 120 includes a tubular shaft 121 that is secured to the uppermost heavier weight 82' with a screw 122 and further includes a guide rod sleeve 124 that rests on and is received by the bushing 91*b'*. The mounting bracket 120 is attached to the upper end of the connecting rod 108' with a screw 126.

In operation, as the belt 66' draws a desired number of heavier weights 82' (selected with the selection pin 98') upwardly, the mounting bracket 120 is lifted by the uppermost heavier weight 82'. As the mounting bracket 120 ascends, it pulls the connecting rod 108' and any lighter weights 102' attached by the selection pin 116' thereto upwardly also. The x-y positions and the angular orientations of the weights 102' are maintained by the interaction between the square shapes of the connecting rod 108', connecting rod apertures 104', and receiving sleeve 114', and by the inability of the mounting bracket 120 to rotate about the bushing 91*b'* due to the presence of the screw 122.

Like the embodiment of FIGS. 1 through 4, the embodiment illustrated in FIGS. 5 and 6 includes systems of heavier and lighter weights positioned in which the stroke of the machine is not impeded by the position of the lighter weight system 100'. In addition, the presence of the counterweight 93 assists in preventing the uppermost heavier weight 82' from tilting due to the attachment of the lighter weight stack 102' thereto.

As another example of an alternative embodiment of the present invention for maintaining the x-y position and angular orientation of the lighter weights 102, the lighter weight system 100 can include a telescoping rod (rather than the receiving sleeve 116) that is attached to the lower end of the connecting rod 108 and fixed to the frame 11 beneath the weights 102. In this configuration, the connecting rod 108 would be assured of being drawn back into its original position within the weights 102. Similarly, an elastic or spring-loaded member can be fixed to the frame 11 and extend through the connecting rod apertures 104 in the weights 102.

Also, one or more guide rods, such as those employed to maintain the orientation and x-y position of the heavier weights 82, can be used for the same purpose with the lighter weights 102. A single guide rod can be employed, with the connecting rod including sleeves at its upper and lower ends that receive and slide upon the guide rod to maintain the orientations and x-y positions of the weights 102.

In a similar fashion, guide members can take the form of a continuous or discontinuous sleeve that contacts a portion of the peripheries of the weights 102 and thereby captures the weights 102 as they travel along their prescribed path. Such guide members can be configured to capture rectangular weights, or the weights themselves can vary in shape (such as taking an hourglass or bow-tie shape) to facilitate engagement with the guide members.

A configuration can also be envisioned in which the orientations and x-y positions of the weights 102 are maintained by a cable, belt, or a chain-driven pulley system. In such a system, the cable would extend vertically through apertures in the weights 102 and would thereby restrict horizontal translation and pivoting of the weights 102.

In an additional alternative embodiment, a basket, box, bin or similar receptacle can be suspended directly from the belt 68 rather than the connecting rod 108. In such an embodiment, the lighter weights 102 are disconnected and stored on a hanger on the frame 11 or some other convenient location. As desired, the lighter weights can be added to the basket to provide resistive weight.

The foregoing embodiments are illustrative of the present invention, and are not to be construed as limiting thereof. The invention is defined by the following claims, with equivalents of the claims to be included therein.

That which is claimed is:

1. An exercise apparatus, comprising:

a frame;

an exercise station;

a set of first weights arranged in a first stack having a top weight, each of said first weights being of a first magnitude;

a first connecting member;

first means for connecting a selected number of said first weights to said first connecting member;

first guiding means for guiding said set of first weights along a first path;

a set of second weights arranged in a second stack, each of said second weights being of a second magnitude that differs from said first magnitude;

a second connecting member affixed to said top weight of said first stack;

second means for connecting a selected number of said second weights to said second connecting member;

second guiding means for guiding said set of second weights along a second path that is non-coincident with said first path; and interconnecting means for interconnecting said first connecting member to said exercise station such that use of said exercise station draws a selected number of said first weights and, if at least said top weight of said first stack is selected, a selected number of said second weights.

2. The exercise apparatus defined in claim 1, wherein said first and second paths are substantially parallel.

3. The exercise apparatus defined in claim 1, wherein said interconnecting means is configured such that, in moving along said first and second paths, an uppermost weight of said first weights and an uppermost weight of said second weights move substantially the same distance.

4. The exercise apparatus defined in claim 1 wherein said first guiding means is adapted to allow an uppermost of said first weights to move at least 15 inches along said first path.

5. The exercise apparatus defined in claim 1, wherein said interconnecting means includes an interconnecting member attached with said exercise station that is movable along a third path, and wherein said interconnecting member is configured such that said interconnecting member moves along said third path a distance that is substantially half of the distance moved by one of said first set of weights along said first path.

6. The exercise apparatus defined in claim 1, wherein said first set of weights comprises a plurality of ten pound weights, and wherein said second set of weights comprises a plurality of one pound weights.

7. The exercise apparatus defined in claim 1, wherein said first connecting member is movable along said first path, and wherein said second connecting member is movable along said second path.

8. The exercise apparatus defined in claim 7, further comprising:

first alignment means for maintaining the x-y positions and angular orientations of said set of first weights along said first path during movement thereof; and second alignment means for maintaining the x-y positions and angular orientations of said set of second weights along said second path during movement thereof.

9. The exercise apparatus defined in claim 8, wherein said second alignment means comprises a guide member that extends parallel to said second path, and wherein each of said second weights includes means for slidably engaging said guide member.

10. The exercise apparatus defined in claim 8, wherein said guide member comprises a telescoping rod attached to said second connecting member and extending through apertures in said second weights.

11. A system of weights for an exercise apparatus, comprising:

a set of first weights arranged in a first stack having a top weight, each of said first weights being of a first magnitude;

a first connecting member;

first means for connecting a selected number of said first weights to said first connecting member;

first guiding means for guiding said set of first weights along a first path;

a set of second weights arranged in a second stack, each of said second weights being of a second magnitude that differs from said first magnitude;

a second connecting member affixed to said top weight of said first stack;

second means for connecting a selected number of said second weights to said second connecting member;

second guiding means for guiding said set of second weights along a second path that is non-coincident with said first path; and interconnecting means for interconnecting said first connecting member to an exercise station of an exercise machine such that use of such exercise station would draw a selected number of said first weights and, if at least said top weight of said first stack is selected, a selected number of said second weights.

12. The system of weights defined in claim 11, wherein said first and second paths are substantially parallel.

13. The system of weights defined in claim 11, wherein an uppermost weight of said first weights and an uppermost weight of said second weights move substantially the same distance.

14. The system of weights defined in claim 11, wherein said first set of weights comprises a plurality of ten pound weights, and wherein said second set of weights comprises a plurality of one pound weights.

15. The system of weights defined in claim 11, further comprising:

first alignment means for maintaining the x-y positions and angular orientations of said set of first weights along said first path during movement thereof; and second alignment means for maintaining the x-y positions and angular orientations of said set of second weights along said second path during movement thereof.

16. The system of weights defined in claim 15, wherein said second alignment means comprises a guide member that extends parallel to said second path, and wherein each of said second weights includes means for slidably engaging said guide member.

17. The system of weights defined in claim 16, wherein said guide member comprises a telescoping rod attached to said second connecting member and extending through apertures in said second weights.

* * * * *